US011130219B2

(12) United States Patent
Boese et al.

(10) Patent No.: US 11,130,219 B2
(45) Date of Patent: Sep. 28, 2021

(54) TOOL FOR FEEDING A FLEXIBLE LINE THROUGH TO A CONNECTING PIECE

(71) Applicant: Ford Global Technologies, LLC, Dearborn, MI (US)

(72) Inventors: Ruben Boese, Cologne (DE); Thomas Rother, Cologne (DE); Olaf Denkel, Cologne (DE); Alex Blesgen, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 498 days.

(21) Appl. No.: 16/041,907

(22) Filed: Jul. 23, 2018

(65) Prior Publication Data

US 2019/0022839 A1 Jan. 24, 2019

(30) Foreign Application Priority Data

Jul. 21, 2017 (DE) ..... 102017212536.5

(51) Int. Cl.
*B25B 27/14* (2006.01)
*B25B 27/00* (2006.01)

(52) U.S. Cl.
CPC ..... *B25B 27/14* (2013.01); *B25B 27/0035* (2013.01)

(58) Field of Classification Search
CPC ..... B23P 11/00; B23P 11/005; B23P 19/00; B23P 19/04; B25B 13/481; B25B 27/0035; B25B 27/14; B25B 27/02; B66F 15/00; Y10T 29/53843; Y10T 29/53878; Y10T 29/53952
See application file for complete search history.

(56) References Cited

U.S. PATENT DOCUMENTS 2,594,908 A * 4/1952 Gaulke ..... E21B 11/005 294/86.14
4,393,583 A * 7/1983 Zwald ..... H01R 43/26 29/857
4,484,384 A * 11/1984 Knowles ..... B23P 11/00 29/237
4,515,042 A * 5/1985 Martin ..... B25B 27/0035 81/55
4,945,791 A * 8/1990 Herschler ..... B25B 13/5016 81/120
5,031,981 A * 7/1991 Peterson ..... G02B 6/3887 385/56
5,146,813 A 9/1992 Stanfill, Jr.
5,253,554 A 10/1993 Riera et al.
(Continued)

FOREIGN PATENT DOCUMENTS

DE 19920754 12/2000
JP 2010149233 7/2010

*Primary Examiner* — Joseph J Hail
*Assistant Examiner* — Arman Milanian
(74) *Attorney, Agent, or Firm* — Burris Law, PLLC

(57) ABSTRACT

A tool for feeding a flexible line through to a connecting piece is provided. In order to simplify the process of connecting a flexible line to a connecting piece in a confined space, the tool includes an elongate shank running axially at least at a first end of the tool and having an axially extending recess for receiving an end portion of the line. The recess has an axially and, in some sections, radially configured through opening for the end portion. The tool further includes a handling region, distanced from the first end, for a user.

12 Claims, 6 Drawing Sheets

(56) References Cited

U.S. PATENT DOCUMENTS

| | | | | |
|---|---|---|---|---|
| 6,124,935 | A | 9/2000 | Matthews | |
| 6,363,596 | B1 * | 4/2002 | Reiter | B25B 27/0035 29/278 |
| 6,397,445 | B1 * | 6/2002 | Reiter | B25B 27/0035 29/213.1 |
| 6,952,982 | B2 | 10/2005 | Williford et al. | |
| 7,181,999 | B1 * | 2/2007 | Skeels | H01R 43/26 81/124.2 |
| 7,249,540 | B1 * | 7/2007 | Hacker | B25B 13/06 279/42 |
| 8,615,863 | B1 | 12/2013 | Hope | |
| 2004/0035260 | A1 * | 2/2004 | Adkison | B25B 13/48 81/124.2 |
| 2009/0160180 | A1 | 6/2009 | Kurtz | |
| 2014/0144300 | A1 * | 5/2014 | Marchand | F16B 23/0061 81/467 |
| 2014/0325816 | A1 | 11/2014 | Ng et al. | |

* cited by examiner 1
2
A
4.2
2.1
7
4.2
7.1

1
2
A
3, 4
7
4.2
2.1
7
2.2
7.1
4.1
7.1

1
2
A
3, 4
7
7
4.2
2.1
2.2
7.1
4.1
7.1

1
7.1
7
7.2
7.2
7
7.1

TOOL FOR FEEDING A FLEXIBLE LINE THROUGH TO A CONNECTING PIECE

CROSS-REFERENCE TO RELATED APPLICATIONS

This application claims priority to and the benefit of German Patent Application No. 102017212536.5 filed on Jul. 21, 2017, the content of which is incorporated herein by reference.

FIELD

The present disclosure relates to a tool for feeding a flexible line, in particular a hose (for instance a cooling hose, heating hose or hydraulic hose), through to a connecting piece.

BACKGROUND

The statements in this section merely provide background information related to the present disclosure and may not constitute prior art.

In various technical sectors, the issue exists of fastening a hose or another flexible line, for instance a cable, to a connecting piece. Here, different types of fastening are known, for instance a purely non-positive connection, in which the connecting piece is pressed into the hose, so that the latter is held by friction forces. In addition, also screw connections or snap-in connections are also known, wherein the hose has at its end a coupling element (a socket, a quick connector or the like), which cooperates with the connecting piece to establish, for instance, a form closure. Although these connections work in principle, it is in some situations barely possible by manual means, due to the confined space, to feed the hose through to the connecting piece and/or fasten it thereto.

Such a situation can arise, for instance, when connecting a medium-carrying hose, for instance a heating hose, in the engine compartment of a motor vehicle. The medium-carrying hose is normally installed or connected at a very late stage of the assembly, and, in particular in modern vehicles, only a small amount of free space is given in the engine compartment. This can result in the hose having to be guided in a region which is too narrow for the hand of a user or, at least, is manually reachable only under great difficulties.

DE 199 20 754 C1 discloses a tool for removing a hose portion fixedly seated on a connecting piece. The tool has a handle region and a rod-shaped or tubular shank extending at right angles therefrom, the end region of which is configured as a pipe section that has on its external wall ribs arranged spirally around the pipe section. It is here provided that the pipe section is screwed in place between the connecting piece and the hose portion, after which the hose portion is pulled off.

U.S. Pat. No. 5,253,554 A4 shows a motor-operated tool for releasing hose clamps. The tool has two arms mounted pivotably within a housing, which are provided to engage on the end of the hose clamp. By means of a hydraulic drive and a mechanical force reversal within the housing, the arms can be swiveled toward each other, whereby, in the manner of hose clamp pliers, they release the hose clamp.

From U.S. Pat. No. 6,952,982 B2 is known a hydraulic tool for the fitting of hose clamps. Within an elongated housing is disposed a movable ram, which cooperates with one end of the hose clamp, while a hook fastened fixedly to the housing engages in an eye at the other end of the hose clamp. The ram can be pressed forward by hydraulic pressurization, whereby it releases a latching mechanism between the two ends of the hose clamp, so that the latter is closed around the hose in accordance with a pretensioning.

U.S. Pat. No. 6,124,935 A discloses an instrument for the alignment of pipes. The instrument is connected via an adapter to a pipe to be aligned, so that it is coaxially aligned with said pipe. The instrument has various bubble-type levels, by which the alignment of the pipe can be checked.

U.S. Pat. No. 8,615,863 B1 discloses a tool for inserting an end piece into a hose. The tool has a lockable clamping mechanism, by means of which it is secured to the hose close to the end thereof. The force generated at a hand lever is transmitted by a transmission to a claw which is fastened to a pull rod. The claw engages on the end piece in order to press this into the hose.

In light of the revealed related art, the simplification of the process of connecting a flexible line to a connecting piece in a confined space or at a poorly accessible location offers further room for improvements.

SUMMARY

The present disclosure proposes to simplify the process of connecting a flexible line to a connecting piece in a confined space.

It should be pointed out that the features and measures which are individually cited in the following description can be mutually combined in any chosen, technically sensible manner and reveal further forms of the present disclosure. The description characterizes and specifies the present disclosure in particular in association with the figures.

By virtue of the present disclosure, a tool for feeding a flexible line through to a connecting piece is provided. The feed here serves to connect the line to the connecting piece. The flexible line can be a hose, which is provided to conduct gases or liquids. In particular, the flexible line can be in the form of a heating hose or radiator hose of a motor vehicle. In principle, the present disclosure is however also applicable, for example, to electric leads, waveguides or glass-fiber cables. The tool serves at least to feed the flexible line through to the connecting piece, and normally also serves to connect the line to the connecting piece. That is to say, also the actual process of connecting the line to the connecting piece is realizable by the tool. The connecting piece can be constituted by any type of element to which the flexible line is intended to be connected. This could be, for instance, another flexible or non-flexible line, a tank or the like. Naturally, the flexible line can have at its end a coupling element, which serves for the positive and/or non-positive connection to the connecting piece. The shape of the coupling element can here, to some extent, be complementary to that of the connecting piece. The coupling element can be constituted by a socket or a connector (for example quick connector), which cooperates with a complementary socket or a connector on the connecting piece.

The tool has an elongate shank, which, at least at a first end of the tool, runs axially. The shank is elongate, which means that its length is significantly greater than its thickness or transverse dimension, for instance at least three times greater, or at least five times greater. At least at a first end of the tool, the course of the shank corresponds to an axial direction. In other words, by the direction running along the shank in this region is defined as the axial direction. In terms of the materials of the shank, few restrictions exist. In order to enable a cost-effective manufacture and, at the same time, a low total weight of the tool, the shank can be made, for instance, at least predominantly of plastic or fiber-reinforced plastic. Alternatively or additionally, also metals, for instance, can be used. A one-piece or multipart production is here possible.

The shank has an axially extending recess for receiving an end portion of the line. The recess, which can also be termed a cavity, is configured within the shank or on the shank. The cavity extends axially and its direction of running can correspond, in particular, to that of the shank. The cavity is provided to receive an end portion of the line, i.e. it is dimensioned sufficiently large that the end portion of the line can be received. Depending on the length of the line, in addition to the end portion also a middle portion, or even the entire line, can be received. The term "end portion" herein should be construed to denote a portion in the region of an end of the line. It is here possible that, in hoses having at the outermost end, a coupling element, which constitutes a thickening, the outermost end is not received in the recess. In this respect, the end portion does not necessarily have to comprise the outermost end of the line.

The recess has an axially, and in some sections radially configured through opening for the end portion. In other words, the recess is configured such that it is open axially (toward the first end or in the direction of running of the shank), and in some sections radially (it could be said toward the side of the shank or transversely to the direction of running of the shank). As used herein, "in some sections" should be construed to mean that part of the through opening, which is arranged in the radial direction with respect to the recess, is not configured circumferentially, but is limited to a portion. The through opening which is thus formed is dimensioned such that the end portion is fed through it into the recess and can also be removed back out of it. It is here possible that individual regions of the through opening are configured too narrow for the lines to be fed through. In particular, it is also possible that the through opening has a transverse dimension which is somewhat smaller than, for instance, a diameter of the line, and that the shank at least in part, for example in the region of the through opening, is elastic, whereby an appropriate introduction of the line is enabled.

The recess is provided to receive the end portion, or it constitutes, to some extent, a mounting for the end portion. It is here possible for the end portion to be held positively and/or non-positively in the recess. A form closure can here partially, thus only within defined directions, be given, insofar as this is sufficient to inhibit the end portion from inadvertently coming loose from the recess as it is fed through to the connecting piece. Despite the form closure, the end portion can also, at least in some regions, be received with play in the recess.

The tool further has a handling region, distanced from the first end, for a user. The handling region, which could also be termed the handle region, is the region by which the user properly guides the tool. In principle, the handling region can be any region which, due to its dimensioning, can be gripped with one hand. In one form, the handling region has a profiled surface in order to facilitate handling or a secure grip. For instance, depressions in which a user can place his finger can be provided. Alternatively or additionally, the surface can be roughened. The handling region can be configured on the shank, adjacent thereto, or at a distance therefrom.

In correct usage, it is provided that the user places the end portion of the line in the recess by inserting it, for instance, laterally (from the radial direction) though the through opening. It is here provided that the outermost end of the line is placed adjacent to the first end of the tool. Depending on the design, the outermost end of the line can here be arranged within the recess or, where appropriate, it can project out of the recess in the axial direction through the through opening. Parts of the line which do not belong to the end portion can project, at a part of the recess that is facing away from the first end, laterally or radially through the through opening, so that, where appropriate, the greater part of the line can be outside the recess, wherein, due to the flexible characteristics of the line, it follows the movements of the end portion. In any event, the recess forms a mounting for the end portion (and, where appropriate, also further parts of the line), so that said end portion can be guided by the tool. The user here grips the tool by the handling region, wherein, by virtue of the elongate configuration of the shank, the user, on the one hand, obtains an increased reach, and, on the other hand, by virtue of a sufficiently narrow configuration of the shank, can operate also in regions in which a guidance of the line with the bare hand would barely be possible for space reasons.

The user can feed the end portion through to the connecting piece in the portrayed manner, and also connect it thereto. The user here moves the tool normally in the axial direction, so that the first end faces in the direction of movement. Once the connection has been established, for instance by a form closure between two complementary connection sockets, the tool can be withdrawn in the opposite direction, wherein the end portion moves out of the recess in the axial direction and is finally freed. All in all, a simple and secure guidance and fastening of the line to the connection piece is thus provided.

According to one form, the shank runs axially over the whole length of the tool. It could also be said that the shank is, in this case, configured straight. A straight configuration of this type normally facilitates handling for a user. However, it should be pointed out that other configurations of the shank may be employed while still remaining within the scope of the present disclosure, for example bent or angled-off configurations in instances when a straight feeding of the line through to the connecting piece is not possible, or is possible only with difficulty.

In order to achieve a longest possible reach for the user, in one form, the handling region is configured at a second end, lying opposite the first end, of the tool. That is to say, the user can handle the tool at one end (the second end), and hence guide and fasten that end portion of the line which is accommodated at the other end (the first end).

In particular, at least one section of the recess may be delimited by a casing portion of the shank. A casing portion of this type partially surrounds the recess and forms, for instance, a groove-like receptacle for the end portion. The casing portion can also be of multipart configuration. To the casing portion can be connected, on the far side of the recess, a solid or, at least externally closed, portion of the shank.

The shank can have a wide variety of cross sections. In particular, the cross section of the shank does not have to be constant, but instead can change along the length of the shank. All in all, polygonal, elliptical, circular or other cross sections are conceivable while still remaining within the scope of the present disclosure. According to another form, the shank is of cylindrical configuration. The cross section in this case is circular, which can be advantageous if, in a tight space, a turning of the tool is desired. In this form, the above-stated casing portion can be configured as a cylinder casing portion. The casing portion is not, of course, configured as a closed cylinder casing, since the recess which is enclosed by it is radially open.

In many cases, for instance when it is a question of a coolant hose, the line has at its end a coupling element, which can establish a form closure and/or force closure with the connecting piece. A coupling element of this type normally protrudes in relation to the flexible sheath of the line. This form can be used to limit or to inhibit, via a form closure, a displacement of the line in relation to the tool. According to one aspect, the casing portion has a radially inwardly directed projection. This projection can be, for instance, of bead-like or web-like configuration and extend in the tangential direction. In the case of a cylindrical casing portion, the projection can be configured as an annular bead.

In another form, the tool has two, with respect to the recess, mutually opposing cheek elements for holding the end portion, wherein at least one cheek element is elastically deflectable. The cheek elements can be formed by parts of an abovementioned casing portion. These can be in the form of separately produced elements or of specially configured portions of a larger element. The at least one elastically deflectable cheek element can either be of inherently elastic configuration or be connected via an elastic element to other parts of the tool. The two cheek elements are here arranged such that the end portion is disposed at least partially between them when it is in the recess. That is to say, the cheek elements act on the end portion from two sides. At least one cheek element is here elastically deflectable, i.e. upon the deflection of the cheek element (normally at least proportionately in the radial direction), a restoring force, by which the cheek element is pressed against the end portion of the line, is generated. In principle, it is sufficient that one cheek element is elastically deflectable, but both cheek elements may be elastically deflectable. The two cheek elements can here receive the end portion between them in a positive locking and/or non-positive locking manner.

In another form, at least one cheek element has at its end a radially inwardly projecting holding portion. As a result of such a holding portion, in some sections a constriction is given, which constriction can provide, for instance, that in this region an axial form closure with a radially outwardly projecting region of the end portion is established. In this case too, in particular both cheek elements can have a projecting holding portion. Insofar as the respective cheek element can be regarded as part of the casing portion, the projecting holding portion also constitutes an abovementioned projection of the casing portion. In order to make it easier to release the tool from the line once this has been connected to the connecting piece, the holding portion can have a beveled portion or a chamfer, by which, upon the axial withdrawal of the tool, a force by which the respective cheek element is elastically deflected is generated.

Furthermore, in yet another form at least one cheek element has at its end an arcuate bearing portion. The bearing portion can be configured on an above-described holding portion, or form a radially inner part of the same. The bearing portion is provided to bear against the end portion of the line. Insofar as the line normally has a round cross section, the bearing portion, in conformity herewith, is of arcuate configuration, wherein the arc runs, of course, tangentially. For instance, both cheek elements can respectively have a bearing portion which corresponds to a circular arc of less than 180°, for instance between 60° and 160°. The two bearing portions then jointly enclose the end portion of the line on a circular arc between 120° and 320°, which is normally sufficient for a secure mounting. The abovementioned beveled portion can be configured on the bearing portion. In addition, it is favorable if at least one cheek element has at its end a tapered face, i.e. a chamfer.

The secure reception and guidance of the line is in general improved if a longer piece of the line can be received in the recess. In order to provide this, an axial dimension of the recess measures at least double a radial dimension, according to one form. For example, the axial dimension can, in particular, measure at least three times, or at least four times, the radial dimension.

In many cases, for instance in the fitting of the radiator hose, the relevant work area containing the connecting piece is not only poorly accessible, but also possibly poorly illuminated. In order to facilitate the feeding and fitting of the line, in one form, a light source is arranged at the first end for lighting a region lying axially before the first end. The light source can be formed, for instance, by one or more LED's, which are operated via a battery that is integrated in the tool. Naturally, a switch for switching the light source on and off can be arranged in the handling region. However, other forms too are possible, for instance in the casing portion could be arranged a switch or pressure sensor, which reacts to the introduction of the line into the recess and subsequently activates the light source.

The through opening can have an axially arranged end face portion and a radially arranged side portion. The side portion can here form to some extent in the tangential direction an interruption of the casing portion. In one form, in order to provide a secure reception of the end portion of the line within the recess, the side portion extends in the tangential direction over at most half of the circumference (i.e. at most 180° in the peripheral direction) of the shank. In this form, the shank (for instance the casing portion) still encloses the line from two opposite sides.

In order to enable access to regions which cannot be reached with the bare hand, the shank is configured relatively long according to one aspect. In particular, it can have a length of at least 30 cm, where appropriate also at least 40 cm or at least 50 cm. Such lengths normally enable a comfortable and trouble-free handling, for instance of a hose within the engine compartment of a motor vehicle.

In order to get into regions which are not accessible with the bare hand, the shank can be configured relatively narrow, according to one form, for instance, having a transverse dimension of at most 6 cm. In the case of a cylindrical shank, the transverse dimension is constituted by the diameter. The transverse dimension can continue to measure at most 5 cm. Naturally, a minimum transverse dimension may be predefined by the diameter of the hose to be received.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

In the different figures, same parts are provided with the same reference symbols, and so these are generally also only described once.

Figure 1:
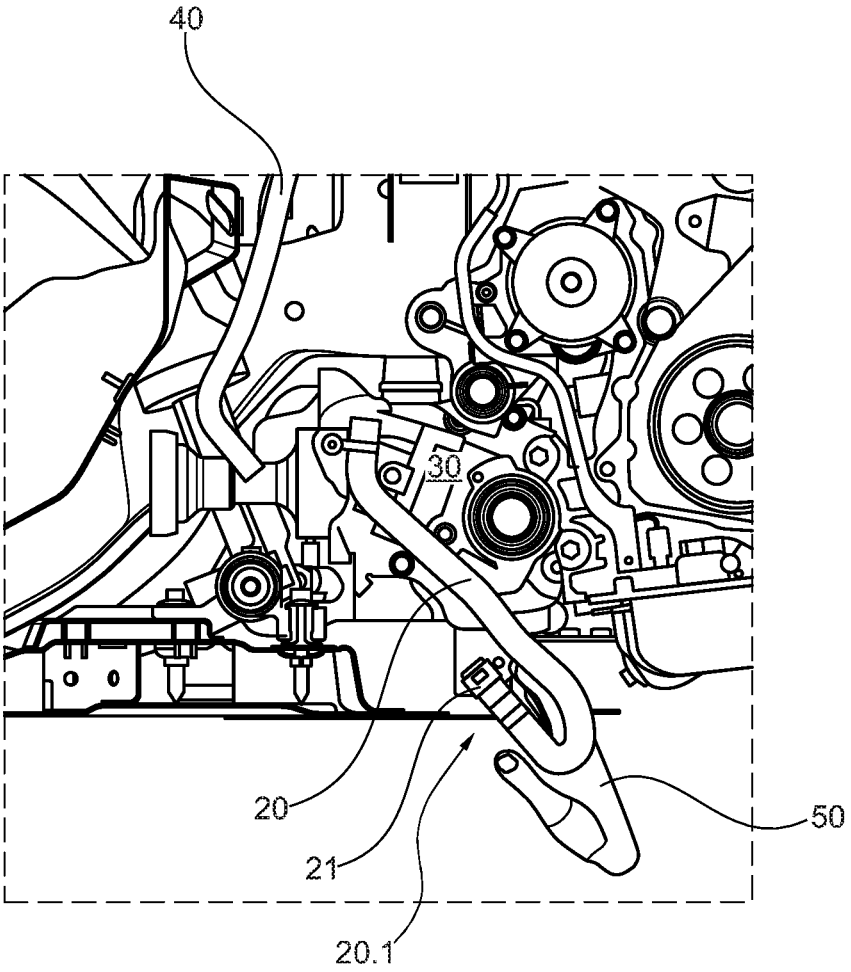
FIG. 1 shows a side view of an engine compartment of a motor vehicle in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a side view of an engine compartment of a motor vehicle in a relatively late stage of assembly. A medium-carrying hose 20, which, for the sake of simplicity, is hereinafter referred to as a heating hose 20, that on one side is fastened to an engine 30, is here intended to be connected to an extending distributor port 40 fastened to the body of the vehicle. For the establishment of the connection, the flexible heating hose 20 has, on an end portion 20.1, a quick connector 21, which can establish a non-positive connection to the distributor port 40. To this end, at least the end portion 20.1 is guided, however, it may be guided through a region offering little free space for movement, which is difficult if a user guides the end portion 20.1 with the user's hand 50.

Figure 2:
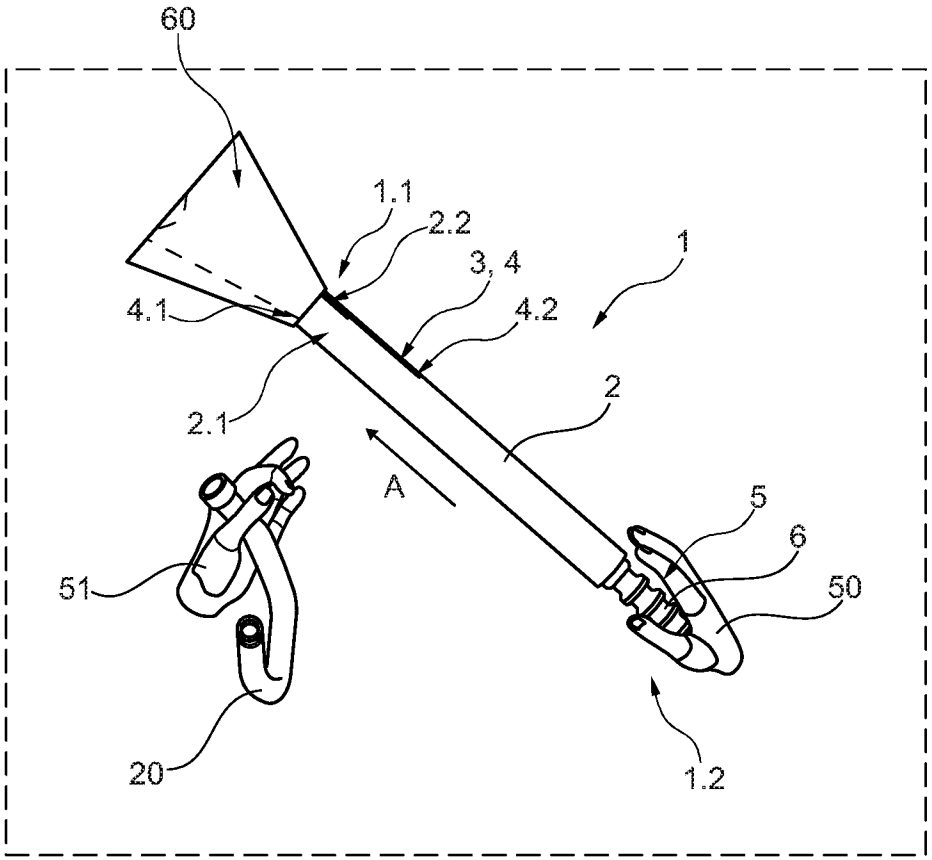
FIG. 2 shows a representation of a tool and of a heating hose according to the present disclosure.

In order to avoid these issues, a tool 1 according to the present disclosure represented in FIG. 2 and in FIGS. 7A to 7D, which has an elongate shank 2, can be used. In the present case, the shank 2 is of cylindrical configuration and extends straight along an axial direction A. Adjacent to a first end 1.1 of the tool 1, in the shank 2 is configured a recess 3, which is partially surrounded by a casing portion 2.1 of the shank 2. The casing portion 2.1 extends in the axial direction and partially tangentially around the recess 3. The recess 3 has a through opening 4, which can be divided into an axially arranged end face portion 4.1 and a radially arranged side portion 4.2. The side portion 4.2 here forms to some extent, an interruption of the casing portion 2.1. At a second end 1.2, lying opposite the first end 1.1 of the tool 1, a handling region 5 (omitted in FIGS. 7A to 7D) having a handle 6 for the hand 50 of the user is formed adjoining the shank 2. The handle 6 has an ergonomically profiled surface.

The casing portion 2.1 has two (2), with respect to the recess 3, mutually opposing cheek elements 7, which are both elastically radially deflectable. In the present case, the cheek elements 7 are configured as elastic separately produced parts, though they can also be produced in one piece with the rest of the shank 2. Each cheek element 7 has at its end a radially inwardly projecting holding portion 7.1, on which an arcuate bearing portion 7.2 is configured. In the form shown, each bearing portion 7.2 runs along an arc of about 150°, which should be seen, however, merely as an example. Close to the first end 1.1 is formed on the casing portion 2.1, by the holding portions 7.1, an inward facing projection 2.2, the function of which is further explained below. In order to further facilitate the work with the tool 1, at the first end 1.1 is arranged a light source (not represented here in detail), by means of which a light cone 60 can be generated in order to illuminate a region lying axially before the first end 1.1. The light source can be switched on and off, for instance, via a switch on the handle 6.

Figure 3:
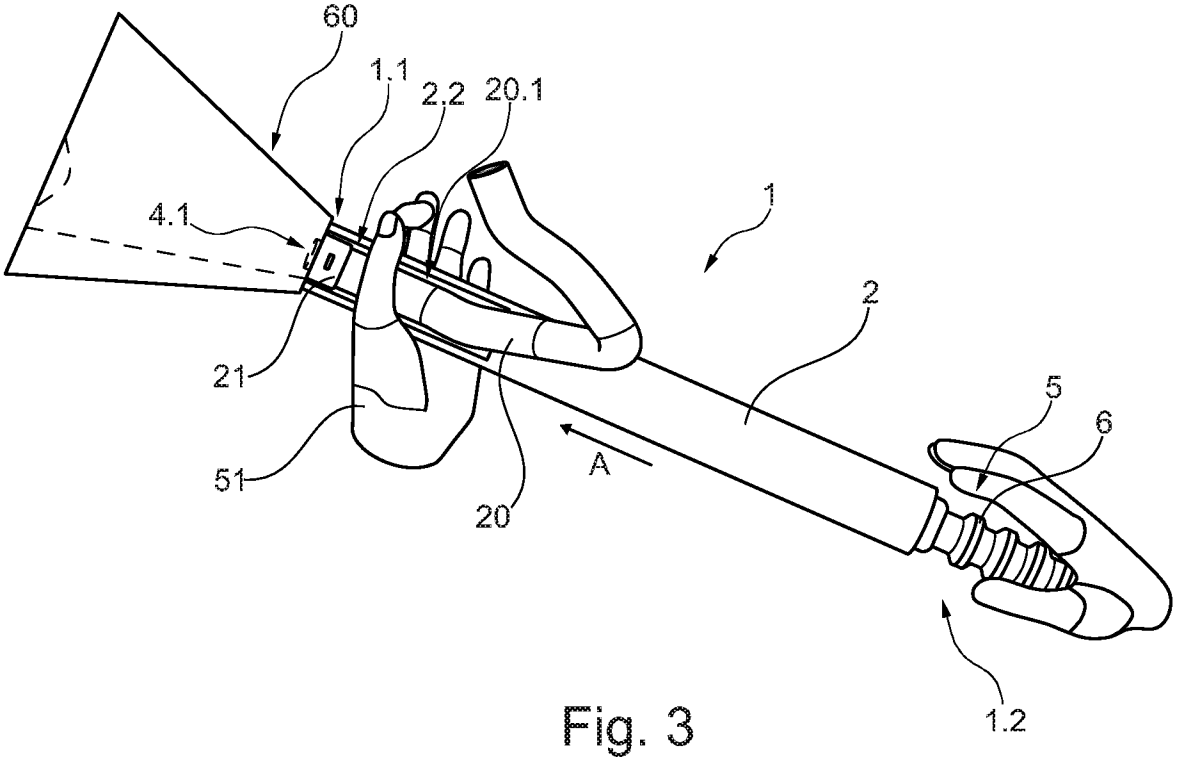
FIG. 3 shows a representation of a tool with a partially inserted heating hose according to the present disclosure.

The user, while with one hand 50 keeping hold of the tool 1 by the handle 6, can with the other hand 51 insert the end portion 20.1 into the recess 3, as represented in FIG. 3. In order to be able to insert the end portion 20.1, the two cheek elements 7 are elastically deflected, so that, with the end portion 20.1 inserted, they bear against this from both sides under pretension and thus, via the bearing portions 7.2, establish a form closure and a force closure. The projection 2.2 formed by the holding portions 7.1 can here establish in the axial direction a form closure with the quick connector 21, whereby the heating hose 20 is additionally inhibited from moving away from the first end 1.1 in the axial direction.

Figure 5:
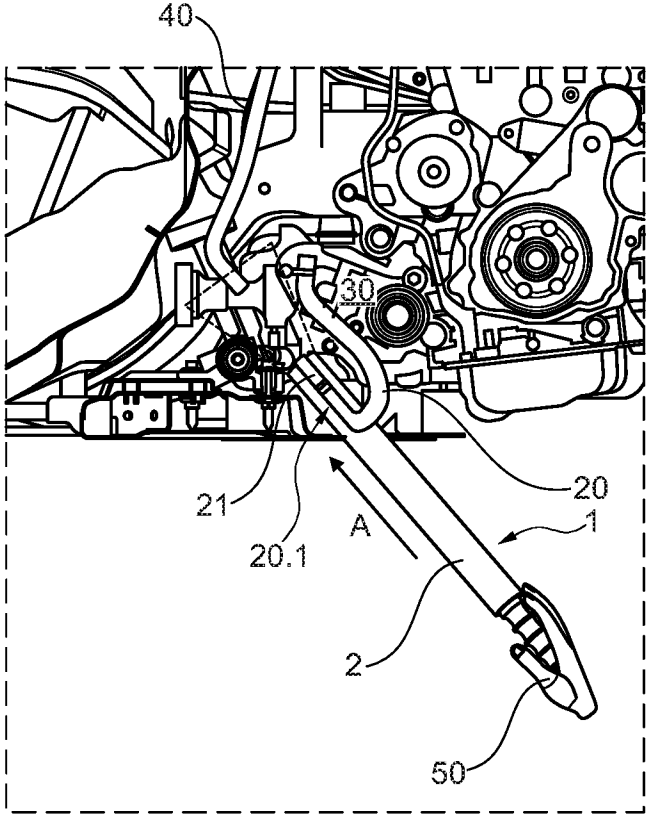
FIG. 5 shows a side view of a tool within an engine compartment in a second phase of the assembly process according to the present disclosure.
Figure 4:
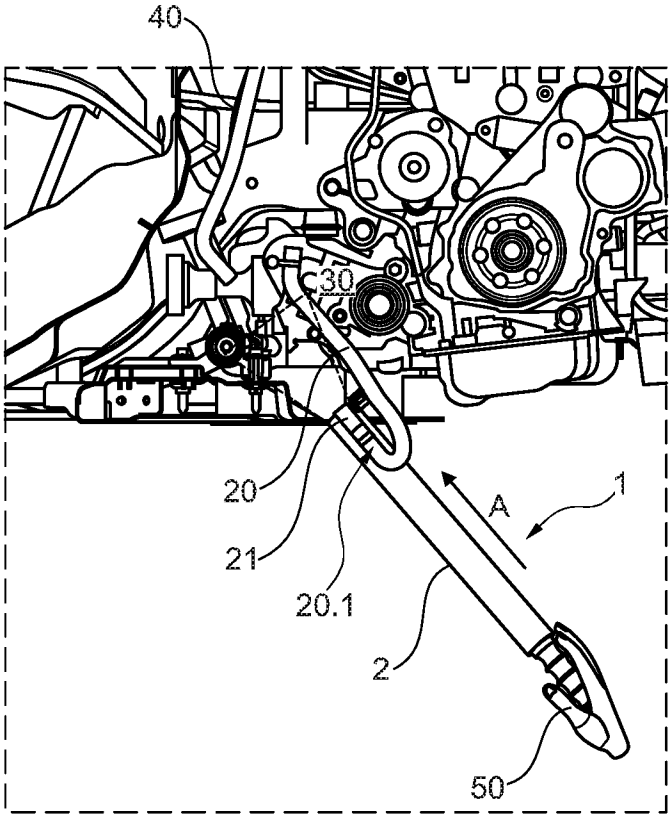
FIG. 4 shows a side view of a tool within an engine compartment in a first phase of an assembly process according to the present disclosure.
Figure 6:
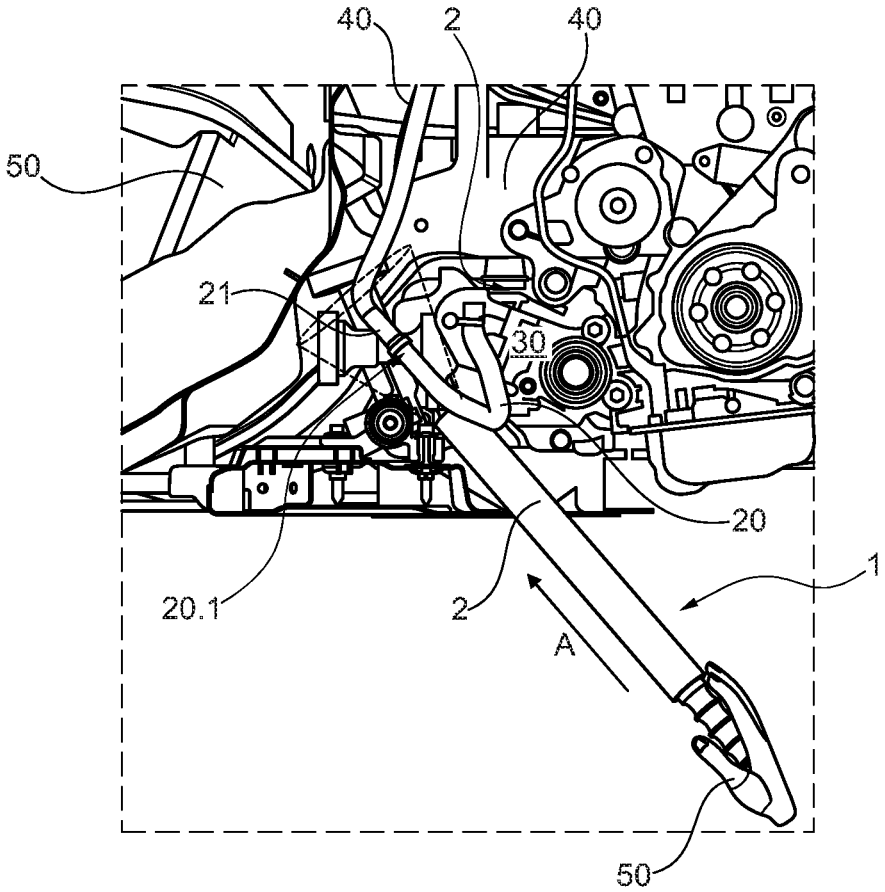
FIG. 6 shows a side view of a tool within an engine compartment in a third phase of the assembly process according to the present disclosure.
Figures 7A, 7B, 7C, 7D:
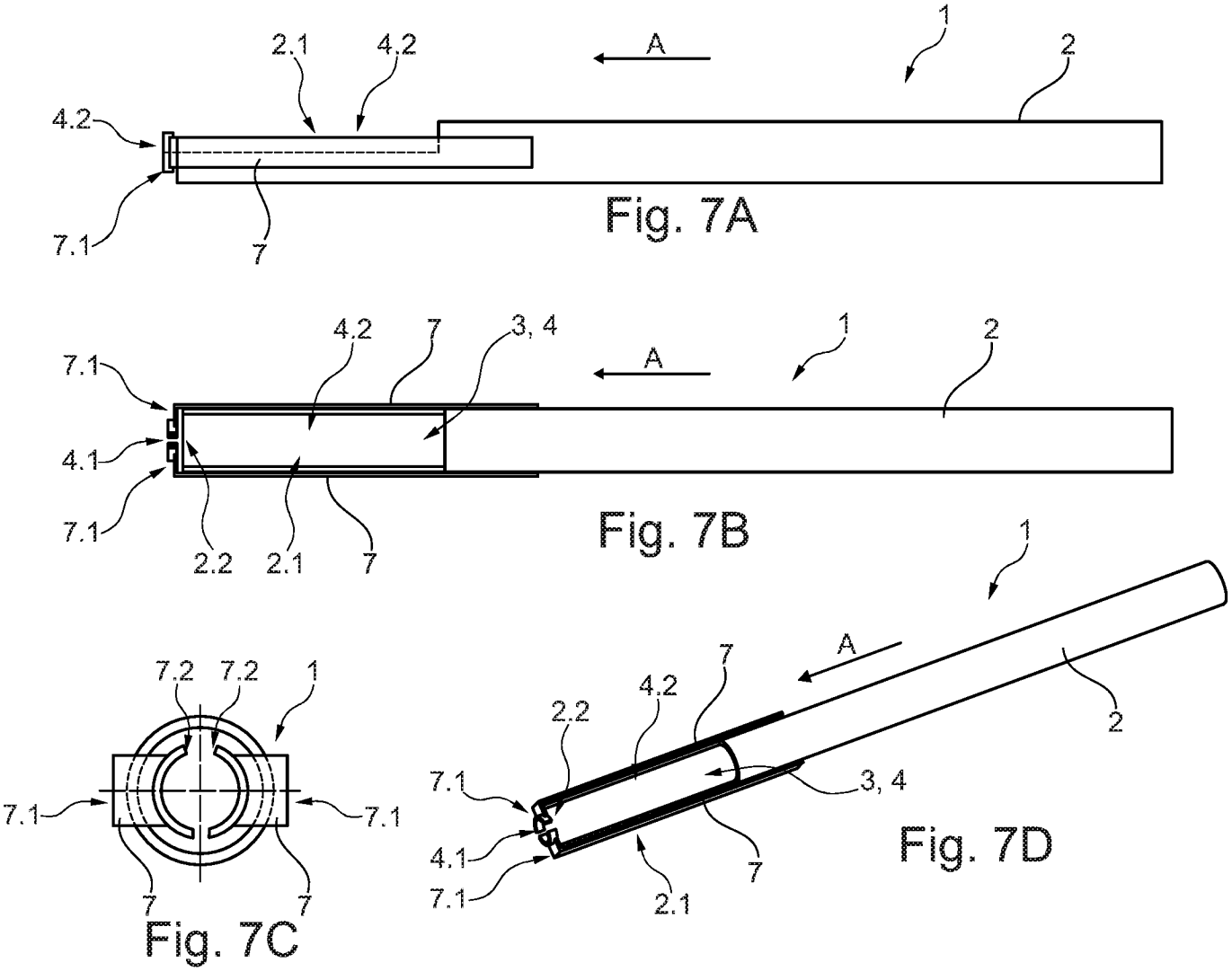
FIG. 7A shows a side view of a tool according to the present disclosure.
FIG. 7B shows a top view of the tool of FIG. 7A.
FIG. 7C shows a front view of the tool of FIG. 7A.
FIG. 7D shows a perspective view of the tool of FIG. 7A.

FIGS. 4-6 show the manipulation of the heating hose 20 by the tool 1 within the engine compartment. In FIG. 4, as can clearly be seen, the user can keep sufficient distance from the cramped region with his hand 50 and yet has secure control over the guidance of the end portion 20.1. Moreover, the region around the distributor port 40 is sufficiently illuminated by the light cone 60, whereby a visual monitoring is facilitated. The user proceeds to push the tool with the end portion 20.1 forward in the axial direction A, until the quick connector 21 engages on the distributor port 40. The force which is desired for this can be readily applied by the user via the tool 1.

FIG. 5 shows a state in which the connection between the end portion 20.1 and the distributor port 40 has been established. Since the end portion 20.1 is by now secured, the tool 1 can be withdrawn counter to the axial direction A, wherein the end portion 20.1 is brought out of the recess 3 through the through opening 4. The actual exit from the recess 3 here takes place predominantly through the end face portion 4.1, while a part of the heating hose 20 slides substantially axially along the side portions 4.2. For a final detachment of the heating hose 20, an elastic deflection of the two cheek elements 7 occurs once again. This deflection can be aided by providing on each of the bearing portions 7.2, for instance, in FIG. 7C, the topmost region, a beveled region or a chamfer, by which, in the axial extraction of the tool 1, a radial force upon the respective cheek element 7 is generated.

The tool 1 which is shown here has in the axial direction a total length of about 53 cm, wherein the shank 2 has a length of about 40 cm and a diameter of about 4.5 cm. These dimensions are, of course, purely illustrative, and can be varied according to the diameter of the hose 20 or according to the spatial conditions in the region of the connection to be established. In any event, it is clear that the shank 2 is configured markedly slimmer than a hand 50, 51 of a user, wherein a relatively long reach is also obtained.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A tool for feeding a flexible hose through to a connecting piece, the tool comprising:

an elongate shank running axially between a first end and a second end and having an axially extending recess for receiving an end portion of the flexible hose, the recess being partially surrounded by a casing portion of the elongated shank and including an axially and radially configured through opening for the end portion of the flexible hose;

mutually opposing cheek elements extending axially from the outer circumference of the elongate shank, wherein at least one of the mutually opposing cheeks is elastically radially deflectable and each of the mutually opposing cheek elements comprises a radially inwardly projecting holding portion with an arcuate bearing portion such that an inward facing projection formed by the radially inwardly projecting holding portion is configured to form a force closure on the flexible hose is provided; and a handling region distanced from the first end of the tool, for a user.

2. The tool as claimed in claim 1, wherein the elongate shank is cylindrical.

3. The tool as claimed in claim 1 further comprising a flexible hose with an end portion positioned in the axially extending recess of the elongated shank, wherein each of the opposing cheek elements includes the arcuate bearing portion and the arcuate bearing portions are pretensioned against the end portion of the flexible hose.

4. The tool as claimed in claim 1, wherein an axial dimension of the recess measures at least double a radial dimension of the recess.

5. The tool as claimed in claim 1 further comprising a light cone at the first end of the tool configured to illuminate a region lying axially before the first end of the tool.

6. The tool as claimed in claim 1, wherein the through opening has an axially arranged end face portion and a radially arranged side portion, wherein the radially arranged side portion extends in a radial direction over at most half of a circumference of the elongate shank.

7. The tool as claimed in claim 1, wherein the elongate shank defines at least one of a length of at least 30 cm and a transverse dimension of at most 6 cm.

8. A tool comprising:

a shank running in an axial direction between a first end and a second end;

a recess partially surrounded by a casing portion of the shank, and including a through opening having an end face portion and a side portion;

mutually opposing cheek elements extending axially from the outer circumference of the shank, wherein at least one of the mutually opposing cheeks is elastically radially deflectable and each of the mutually opposing cheek elements comprises a radially inwardly projecting holding portion with an arcuate bearing portion such that an inward facing projection formed by the radially inwardly projecting holding portion is configured to form a force closure on a flexible hose is provided; and a handle region adjoining the shank.

9. The tool as claimed in claim 8, wherein the end face portion of the through opening extends in the axial direction and the side portion of the through opening extends in a radial direction.

10. The tool as claimed in claim 8, wherein the side portion of the through opening extends in a radial direction over at most half of a circumference of the shank.

11. A tool for feeding a flexible line through to a connection piece, the tool comprising:

a shank running in an axial direction and including a casing portion comprising opposing cheek elements extending axially from the outer circumference of the shank, wherein at least one of the opposing cheek elements is elastically deflectable and an end of each of the opposing cheek elements includes a radially inwardly projecting holding portion with an arcuate bearing portion such that an inward facing projection formed by the radially inwardly projecting holding portion is configured to form a force closure on the flexible line is provided near a first end of the tool;

a recess partially surrounded by the casing portion of the shank, the recess being partially surrounded by a casing portion of the shank and including a through opening having an end face portion extending in the axial direction and a side portion extending in a radial direction;

a handle region adjoining the shank; and a flexible hose comprising an end portion with a quick connector, wherein the recess receive the end portion of the flexible hose and the opposing cheek elements establish the force closure on the quick connector of the flexible hose.

12. The tool as claimed in claim 11, wherein;

the arcuate bearing portion of each of the opposing cheek elements is pretensioned against the end portion of the flexible hose.

* * * * *